US008875690B2

(12) United States Patent
Chor-Ming

(10) Patent No.: US 8,875,690 B2
(45) Date of Patent: Nov. 4, 2014

(54) TOY GUN

(75) Inventor: Ma Chor-Ming, Tsim Sha Tsui (HK)

(73) Assignee: Buzz Bee Toys (H.K.) Company Limited, Kowloon (HK)

( * ) Notice: Subject to any disclaimer, the term of this patent is extended or adjusted under 35 U.S.C. 154(b) by 352 days.

(21) Appl. No.: 13/273,919

(22) Filed: Oct. 14, 2011

(65) Prior Publication Data

US 2012/0285433 A1 Nov. 15, 2012

(30) Foreign Application Priority Data

May 13, 2011 (CN) ..... 2011 1 0124286
May 13, 2011 (HK) ..... 11104742

(51) Int. Cl.

| | |
|---|---|
| ***F41B 7/08*** | (2006.01) |
| ***F41B 11/00*** | (2013.01) |
| ***F41B 11/54*** | (2013.01) |
| ***F41A 15/02*** | (2006.01) |
| ***F41B 7/00*** | (2006.01) |
| ***F41B 11/89*** | (2013.01) |

(52) U.S. Cl.

CPC . *F41B 9/27* (2013.01); *F41B 11/54* (2013.01); *F41A 15/02* (2013.01); *F41B 7/006* (2013.01); *F41B 7/08* (2013.01); *F41B 11/89* (2013.01)

USPC ..... 124/82; 124/45; 124/48; 124/51.1; 124/56; 124/80; 42/54; 446/473

(58) Field of Classification Search

CPC ..... F41B 11/54; F41B 7/006

USPC ..... 124/45, 48, 51.1, 56, 80, 82; 446/473; 42/54

See application file for complete search history.

(56) References Cited

U.S. PATENT DOCUMENTS

| | | | | |
|---|---|---|---|---|
| 2,887,809 | A * | 5/1959 | Nichols | 124/16 |
| 2,921,573 | A * | 1/1960 | Horowitz et al. | 124/27 |
| 3,111,121 | A * | 11/1963 | Baggott | 124/67 |
| 3,552,372 | A * | 1/1971 | Wilkerson | 124/67 |
| 5,213,089 | A * | 5/1993 | DeLuca | 124/29 |
| 5,284,274 | A * | 2/1994 | Lee et al. | 222/79 |
| 5,323,755 | A * | 6/1994 | Hsieh | 124/66 |
| 5,381,928 | A * | 1/1995 | Lee et al. | 222/79 |
| 5,592,931 | A * | 1/1997 | Johnson et al. | 124/69 |
| 5,596,978 | A * | 1/1997 | Johnson et al. | 124/72 |
| 5,699,781 | A * | 12/1997 | Johnson et al. | 124/69 |
| 5,787,869 | A * | 8/1998 | Johnson et al. | 124/69 |
| 6,439,216 | B1 * | 8/2002 | Johnson et al. | 124/70 |
| 7,537,001 | B2 * | 5/2009 | Ma | 124/69 |
| 7,677,235 | B2 * | 3/2010 | Zimmerman | 124/66 |
| 7,789,729 | B1 * | 9/2010 | Ivanic et al. | 446/473 |

(Continued)

*Primary Examiner* — Gene Kim
*Assistant Examiner* — Alexander Niconovich
(74) *Attorney, Agent, or Firm* — Raymond R. Ferrera; Adams and Reese LLP

(57) ABSTRACT

A toy gun that includes a dart ejecting device and a magazine for loading darts and shells is disclosed herein. The gun also includes a shell ejecting device having a driving mechanism and a shell ejecting mechanism. The driving mechanism includes a handle, a linkage through the center of the magazine, and a sliding piece, each of which are joined together in sequence. Other modifications and features suitable for practice therewith, and methods and means of operating the device, are also disclosed.

14 Claims, 9 Drawing Sheets

(56) References Cited

U.S. PATENT DOCUMENTS

| | | | | |
|---|---|---|---|---|
| 7,841,327 | B2 * | 11/2010 | Sopinsky et al. | 124/16 |
| 8,082,909 | B2 * | 12/2011 | Sopinsky et al. | 124/16 |
| 8,387,605 | B2 * | 3/2013 | Brown et al. | 124/27 |
| 8,402,956 | B2 * | 3/2013 | Dakan et al. | 124/27 |
| 8,402,958 | B2 * | 3/2013 | Victor et al. | 124/45 |
| 2006/0283431 | A1 * | 12/2006 | Lee et al. | 124/41.1 |
| 2011/0041821 | A1 * | 2/2011 | Brown et al. | 124/27 |
| 2012/0304975 | A1 * | 12/2012 | Ma | 124/73 |

* cited by examiner

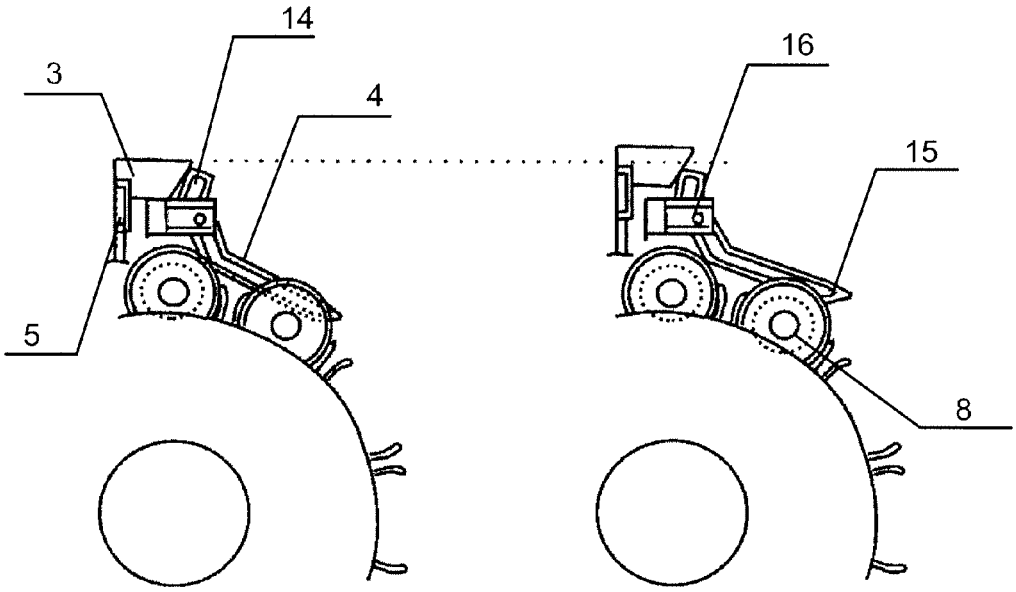
Figure 5A
Figure 5B
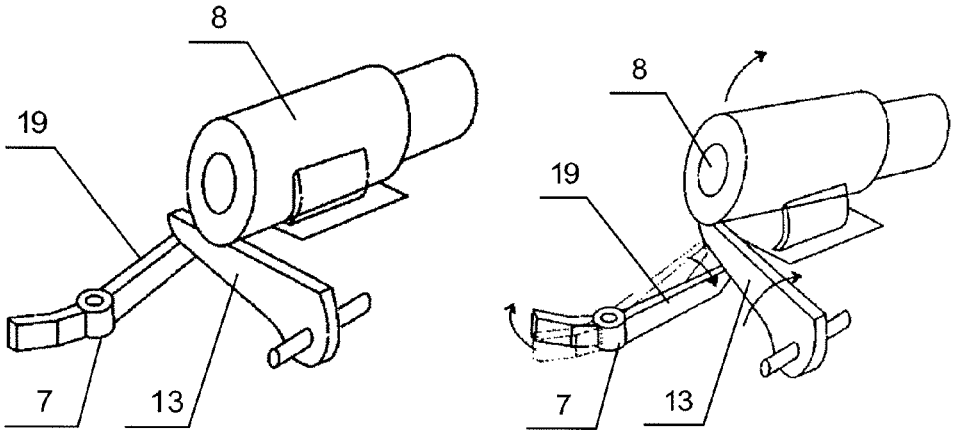
Figure 6A
Figure 6B

TOY GUN

CROSS-REFERENCE TO RELATED APPLICATIONS

Pursuant to 35 U.S.C. 119(a), the instant application claims priority to prior Hong Kong application number 11104742.0, filed May 13, 2011; and People's Republic of China application number 201110124286.0, filed May 13, 2011.

FIELD OF THE INVENTION

The present invention relates to a toy, more particularly, relates to a toy gun which is capable of ejecting darts as well as empty shells in use without ejecting shells with darts therein.

BACKGROUND OF THE INVENTION

As toy guns loaded with foam darts are with fun and safety, they are popular among children. The foam darts usually have separate darts and shells. After being loaded in the shells, the darts together with the shells are then loaded into the magazines. In the prior art, in order to re-load new darts, a player has to take out the magazine and release the shell when all the darts have been fired. The solution has drawbacks that such cumbersome procedure may affect the game progress and emotion of the players when they are in the exciting game with the toy gun.

SUMMARY OF THE INVENTION

It is an object of the present invention to provide a toy gun, which is capable of ejecting the empty shells without unloading the magazine.

According to the present invention, a toy gun comprises a dart ejecting device and a magazine for loading darts and shells, wherein the toy gun further comprising a shell ejecting device which comprises a driving mechanism and a shell ejecting mechanism; the driving mechanism comprises a handle, a first linkage through the center of the magazine, and a sliding piece, which are linked together in sequence; the handle may drive the sliding piece to slide back and forth via the first linkage; the shell ejecting mechanism comprises a ejector control lever, a pivot and a shell ejecting lever; the end face of the first end of the ejector control lever is a curved surface or an inclined surface to coordinate with the sliding piece, while the second end may be lapped with the shell ejecting lever so as to control the shell ejecting lever.

In the toy gun according to the embodiment of the present invention, the shell ejecting device further comprises a dart sensor mechanism; wherein, the dart sensor mechanism comprises a dart sensor lever fixed on the gun body in a hinging way, a second linkage and a transmission element positioned between the dart sensor lever and the second linkage; the transmission element is connected with the second linkage so as to drive the second linkage to move; the ejector control lever is linked with the pivot so as to swing around the pivot.

In the toy gun according to the embodiment of the present invention, the contacting end of the dart sensor lever is linked with the transmission element; while the corresponding free end is drooping at the position of the dart head in the dart station close to a shell.

In the toy gun according to the embodiment of the present invention, the shell ejecting mechanism further comprises a stopper.

In the toy gun according to the embodiment of the present invention, the stopper is positioned between the ejector control lever and the second linkage, and is connected with the second linkage so that the position of the stopper is controlled by the second linkage.

In the toy gun according to the embodiment of the present invention, the shell ejecting mechanism further comprises a reset spring, wherein, one end of the reset spring is connected with the ejector control lever, and the other end is connected with the gun body.

In the toy gun according to the embodiment of the present invention, the sliding piece is provided with one end linked with the first linkage, and the other end provided with a protrusion.

In the toy gun according to the embodiment of the present invention, the contacting end of the dart sensor lever is provided with a hook, and the transmission element is provided with a corresponding groove coordinating with the hook.

In the toy gun according to the embodiment of the present invention, the stopper is positioned proximate to the first end of the ejector control lever relative to the pivot.

In the toy gun according to the embodiment of the present invention, the transmission element is a linkage linked to the contacting end of the dart sensor lever.

In the toy gun according to the embodiment of the present invention, the stopper is positioned proximate to the first end of the ejector control lever relative to the pivot.

In the toy gun according to the embodiment of the present invention, the contacting end of the dart sensor lever leans to the transmission element, and the contacting surface between them is an inclined plane.

In the toy gun according to the embodiment of the present invention, the stopper is positioned proximate to the second end of the ejector control lever relative to the pivot.

In the toy gun according to the embodiment of the present invention, the housing of the magazine is provided with an aperture at the position corresponding to the dart station close proximate to the shell for ejecting the empty shell.

The advantageous effects of the present invention are: with the toy gun according to the present invention, there is no need to unload the magazine for ejecting the empty shell in time when in the game that a toy gun is used.

These and other advantages, aspects and novel features of the present invention, as well as details of an illustrated embodiment thereof, will be more fully understood from the following description and drawings.

BRIEF DESCRIPTION OF THE DRAWINGS

The present invention is described with reference to the accompanying drawings and embodiments in the following. In the Figures:

FIG. 5A is a local section view in the direction of the arrows A-B in FIG. 2 for the transmission element according to the third embodiment of the present invention;

FIG. 5B is a local section view in the direction of the arrows A-B in FIG. 2 for the transmission element according to the third embodiment of the present invention;

FIG. 6A is a local structure schematic view illustrating the shell ejecting mechanism of the toy gun according to the embodiment of the present invention;

FIG. 6B is a local structure schematic view illustrating the shell ejecting mechanism of the toy gun according to the embodiment of the present invention;

DETAILED DESCRIPTION OF THE PREFERRED EMBODIMENT

Figure 1:
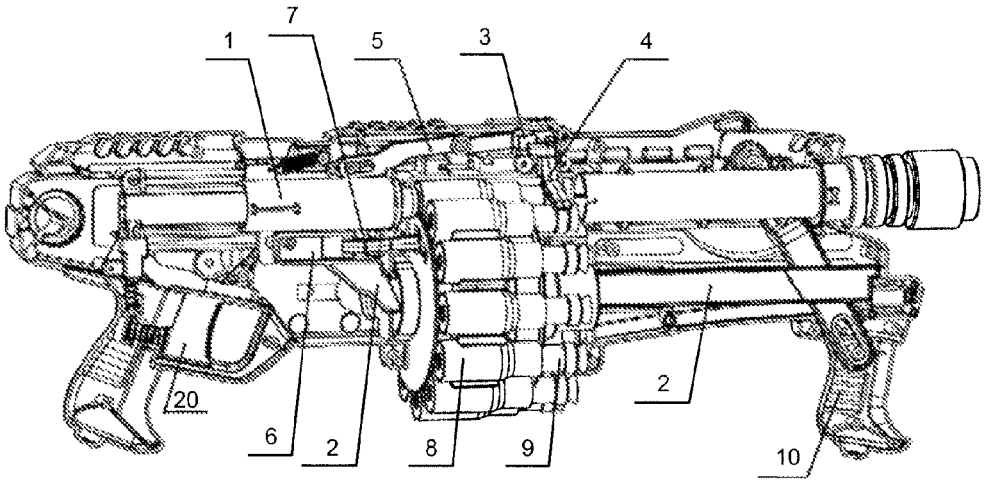
FIG. 1 is a stereogram for the toy gun according to the embodiment of the present invention.
Figure 2:
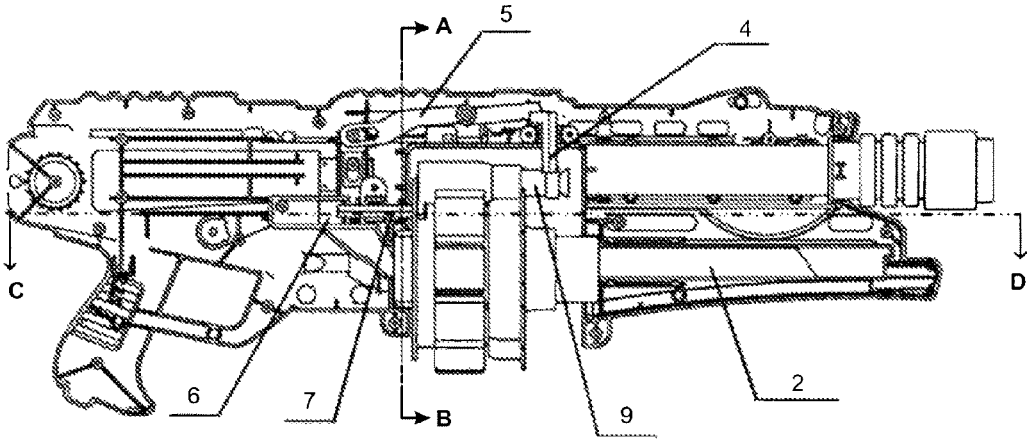
FIG. 2 is a structure schematic view for the toy gun according to the embodiment of the present invention.

Hereinafter, embodiments of the present invention will be described in detail with reference to the accompanying drawings. Reference should now be made to the drawings, in which the same reference numerals are used throughout the different drawings to designate the same or similar components.

The direction in the present invention is defined as: the direction in which the darts are ejected is designated as a horizontal direction forward.

Referring to FIGS. 1 to 6B, in one embodiment of the present invention, in addition to a cylindrical magazine and a dart ejecting device for loading the darts 9 and shells 8, a toy gun also comprises a shell ejecting device. Wherein, the shell ejecting device comprises a driving mechanism and a shell ejecting mechanism. In this embodiment, it is preferred that the shell ejecting device also comprises a dart sensor mechanism. Herein, the magazine and the dart ejecting device are similar to the corresponding devices in the existing toy gun, respectively, which belong to the prior art. The driving mechanism comprises a handle 10, a first linkage 2 through the center of the magazine, and a sliding piece 6, which are linked together in sequence. Wherein, the handle 10 positioned at the front end of the gun body is shared by the above mentioned dart ejecting device and the shell ejecting device herein. The first linkage 2 is composed of a group of linkages which are linked in sequence and the most front end of the first linkage 2 is linked to the handle 10. As the handle 10 is pushed forward or backward, the first linkage 2 is driven to move correspondingly. The sliding piece 6 is arranged behind the magazine, with one end linked to the tail end of the first linkage 2 and with another end provided with a protrusion. The downward movements of the first linkage 2 by means of the handle 10 may drive the sliding piece 6 to slide back and forth in the horizontal direction.

The dart sensor mechanism is provided with a dart sensor lever 4, a second linkage 5 and a transmission element 3 positioned between the dart sensor lever 4 and the second linkage 5. The dart sensor lever 4 is fixed on the gun body in a hinging way, and may swing around a connecting shaft 16 at the hinge joint. The transmission element 3 is connected with the second linkage 5 so that it may drive the second linkage 5 to move. The free end 15, which is proximate to one side of the connecting shaft 16, of the dart sensor lever 4 droops at the position of the dart head in the dart station close to (or closet to) a shell 1. In another word, the dart station close to the shell 1 is the dart station close to the shell 1 in the magazine and is in front of the dart station in the shell 1 in the rotation direction of the magazine.

The contacting end 14, which is corresponding to the free end 15 and proximate to the other side of the connecting shaft 16, of the dart sensor lever 4 is linked to the transmission element 3. The specific link type depends on the structures of both the transmission element 3 and the contacting end 14, wherein, the specific link type can be contacting link, snap-fits or fixed connection.

Figure 3A:
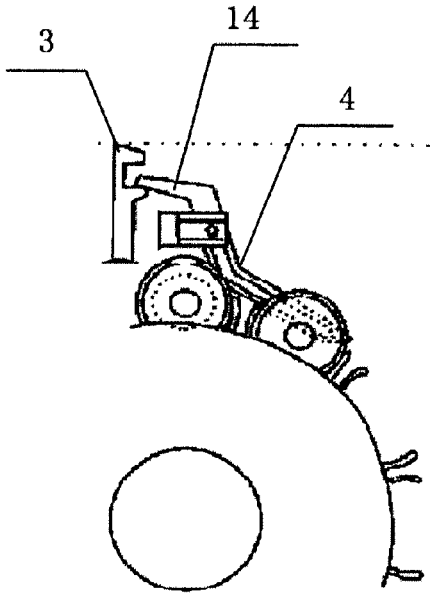
FIG. 3A is a local section view in the direction of the arrows A-B in FIG. 2 for the transmission element according to the first embodiment of the present invention.
Figure 3B:
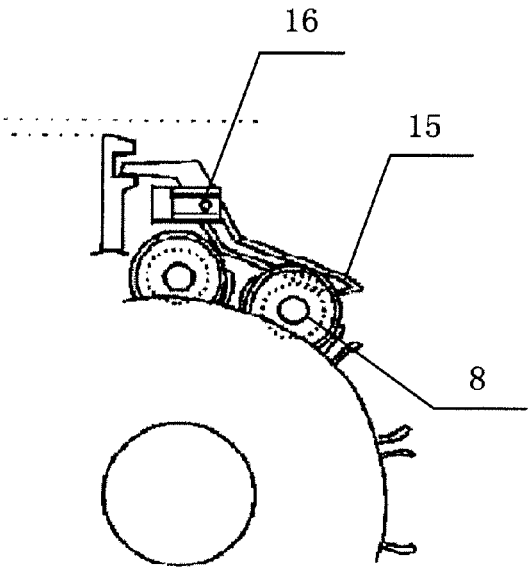
FIG. 3B is a local section view in the direction of the arrows A-B in FIG. 2 for the transmission element according to the first embodiment of the present invention.

In the first embodiment of the present invention, as shown in FIGS. 3A and 3B, a hook is provided at the tail end of the contacting end 14 of the dart sensor lever 4, while the transmission element 3 is provided with a groove coordinating with the hook. As the hook inserts into the corresponding groove, a snap-fits is formed between the contacting end 14 and the transmission element 3. As shown in FIG. 3A, when the free end 15 of the dart sensor lever 4 is not lapped with a dart, the free end 15 droops freely without the effect of an external force. As shown in FIG. 3B, when the free end 15 of the dart sensor lever 4 is lapped with a dart, the free end 15 may deviate from its original location and tilt upward with the dart pressing against the free end 15 so as to make the dart sensor lever 4 begin to swing around the connecting shaft 16. Then during the swing, the dart sensor lever 4 drives the contacting end 14 to press downward in order to make the hook arranged at the tail end of the contacting end 14 now in the groove pull down the transmission element 3. In the process of pulling down, the transmission element 3 may move downward subsequently and its position may be lowered correspondingly, causing the second linkage 5 linked with the transmission element 3 to move downward along with it. When the free end 15 of the dart sensor lever 4 is not lapped with a dart again, the free end 15 of the dart sensor lever 4 may revert to the state of drooping freely, and the external force on the transmission element 3 applied by the contacting end 14 has been removed, as a result of which the transmission element 3 may return to its original location; meanwhile, the second linkage 5 may return to its original location as well.

Figure 4A:
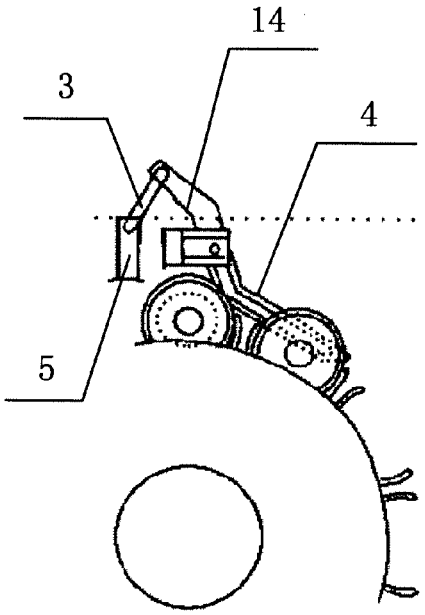
FIG. 4A is a local section view in the direction of the arrows A-B in FIG. 2 for the transmission element according to the second embodiment of the present invention.
Figure 4B:
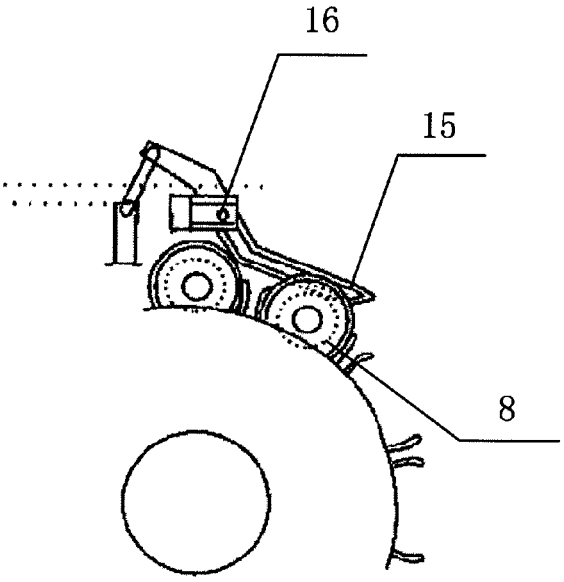
FIG. 4B is a local section view in the direction of the arrows A-B in FIG. 2 for the transmission element according to the second embodiment of the present invention.

In the second embodiment of the present invention, the transmission element 3 is provided as a connecting rod, with its one end linked with the contacting end 14 of the dart sensor lever 4 and the other end linked with the second linkage 5. As shown in FIG. 4A, when the free end 15 of the dart sensor lever 4 is not lapped with a dart, the free end 15 droops freely. As shown in FIG. 4B, when the free end 15 of the dart sensor lever 4 is lapped with a dart, as described above, the pressure upward induced by the dart may be transmitted to the second linkage 5 through the swing of the dart sensor lever and the transmission of the transmission element 3 as the connecting rod.

In the third embodiment of the present invention, as shown in FIGS. 5A and 5B, the contacting end 14 may be contacting linked with the transmission element 3 and the contacting surface of the transmission element 3 is an inclined plane. As shown in FIG. 5A, when the free end 15 of the dart sensor lever 4 is not lapped with a dart, the free end 15 droops freely, with the contacting end 14 leaning to the inclined plane of the transmission element 3. As shown in FIG. 5B, when the free end 15 of the dart sensor lever 4 is lapped with a dart, under the pressure upward induced by the dart, the free end 15 may deviate from its original location and tilt upward, so that the dart sensor lever 4 may begin to swing around the connecting shaft 16. Then during the swing, the contacting end 14 is driven to press against the inclined plane of the transmission element 3. As the contacting surface of the transmission element 3 is an inclined plane, the pressure induced in the process of pressing, which is perpendicular to the inclined plane, may have a component in the upward direction. Thus, with the pressure of the contacting end 14, the transmission element 3 along with the second linkage 5 in connection with it may move upward. When the free end 15 of the dart sensor lever 4 is not lapped with a dart, the free end 15 of the dart sensor lever 4 droops freely, and the pressure on the transmission 3 applied by the contacting end 14 has been removed, so the transmission element 3 and the second linkage 5 may return to its original location, respectively.

Three kinds of exemplary structures of the transmission element 3 have been illustrated above. Of course, other transmission elements can be utilized for the toy gun in the embodiment of the present invention. The exemplary embodiments described herein are provided for illustrative purpose, and not limiting. Other exemplary embodiments are possible, and modification may be made to the exemplary embodiments within the spirit and scope of the invention.

The shell ejecting mechanism comprises an ejector control lever 7, a pivot 11 and a shell ejecting lever 13, and preferably comprises a stopper 12 in the embodiment. The ejector control lever 7 is linked with the pivot 11 and can swing around the pivot 11. A first end 18 of the ejector control lever 7 is provided with a curved surface or an inclined surface, or other arbitrary shaped surface that is at a certain angle to the bottom surface of the ejector control lever 7 so as to coordinate with the sliding piece 6. A second end 19 is provided to be lapped with the ejector control lever 7 so as to control the action of the shell ejecting lever 13. The stopper 12 is mounted between the ejector control lever 7 and the second linkage 5. The top end of the stopper 12 is connected with the second linkage 5 so as to move along with the second linkage 5. Thus, the position of the stopper 12 is under control of the second linkage 5. Under the control of the second linkage 5, the bottom end of the stopper 12 may act with the ejector control lever 7 so as to control the position change of the ejector control lever 7. Referring to FIGS. 6A and 6B, the ejecting end of the shell ejecting lever 13 which may be pressed against by the shell 8 may press against the second end 19 of the ejector control lever 7. As a result, when the second end 19 is tilting up, the ejecting end of the shell ejecting lever 13 may be driven to move, so that the shell 8 may be ejected out in the direction of the arrow as shown in FIG. 6.

Figure 7A:
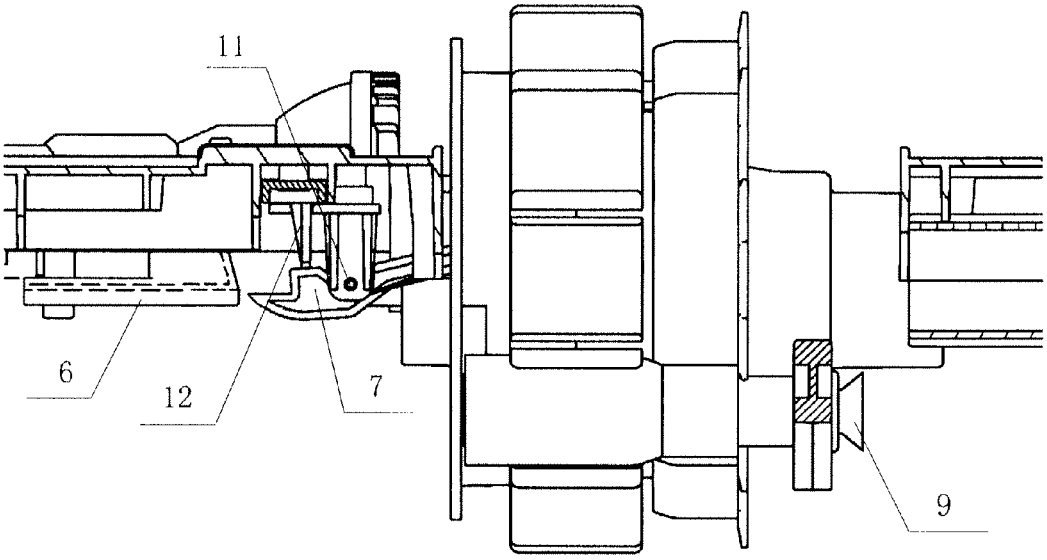
FIG. 7A is a first local section view in the direction of the arrows C-D in FIG. 2 when the shell sensor level is not lapped with a dart, according to the first embodiment of the present invention.
Figure 7B:
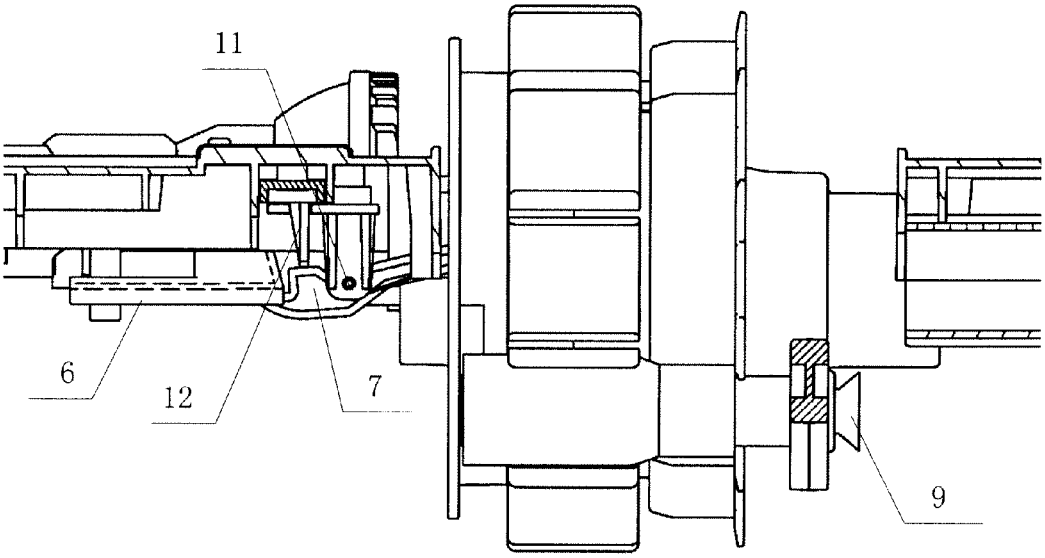
FIG. 7B is a second local section view in the direction of the arrows C-D in FIG. 2 when the shell sensor level is not lapped with a dart, according to the first embodiment of the present invention.
Figure 7C:
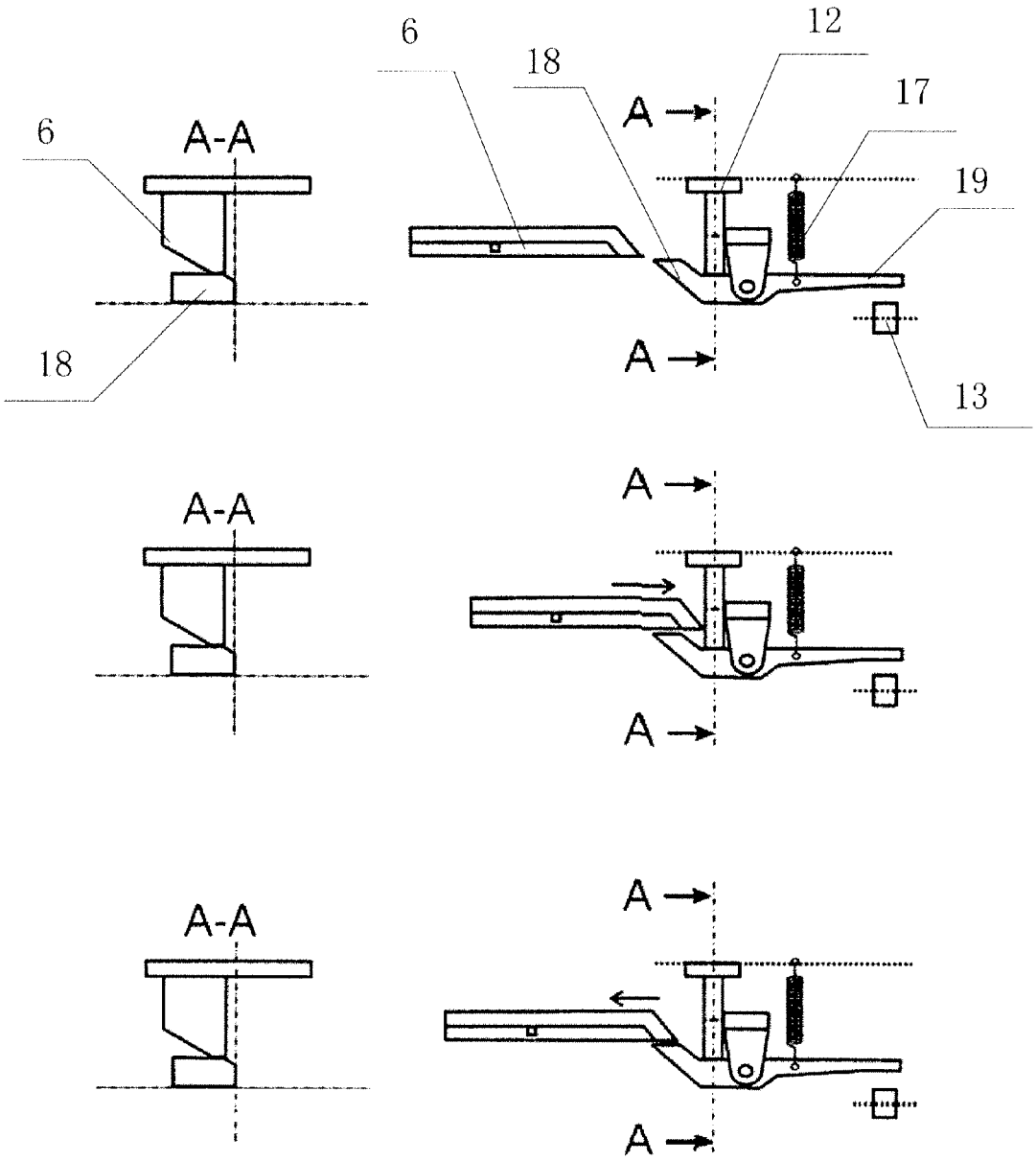
FIG. 7C is a local schematic diagram in the direction of the arrows C-D in FIG. 2 when the shell sensor level is not lapped with a dart, according to the first embodiment of the present invention.
Figure 7D:
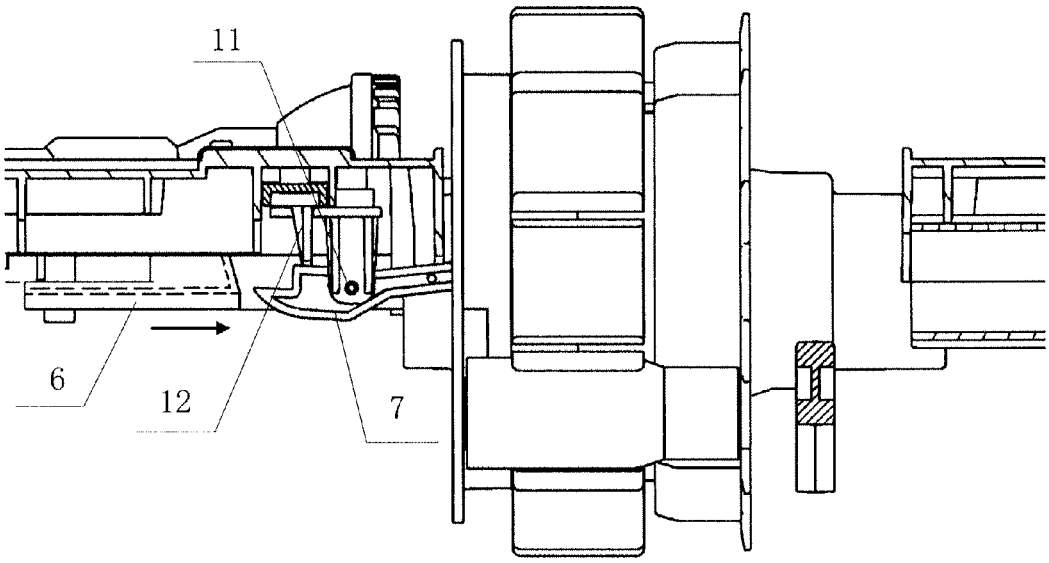
FIG. 7D is a first section view in the direction of the arrows C-D in FIG. 2 when the shell sensor lever is lapped with a dart, according to the first embodiment of the present invention.
Figure 7E:
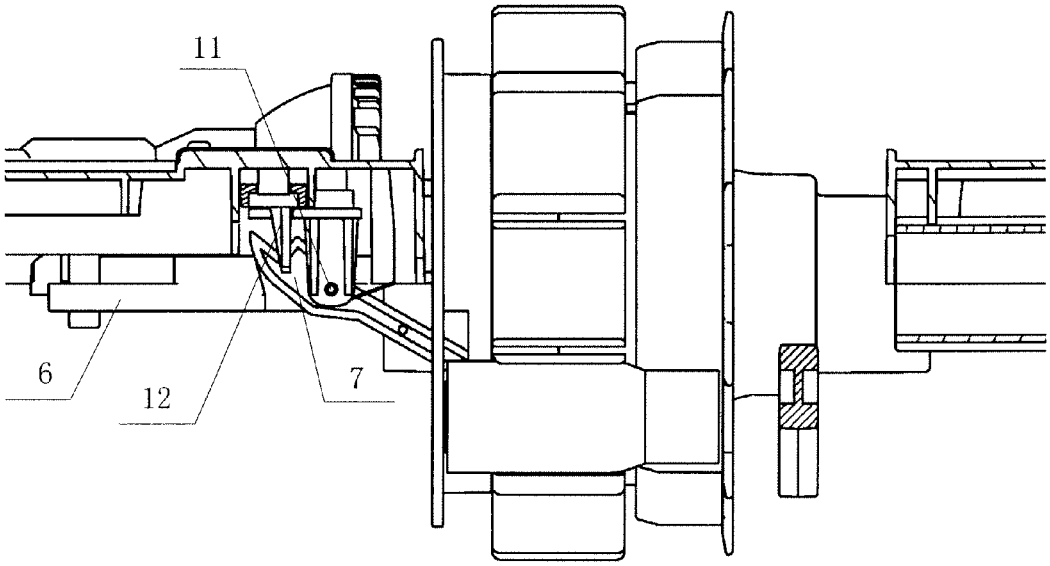
FIG. 7E is a second section view in the direction of the arrows C-D in FIG. 2 when the shell sensor lever is lapped with a dart, according to the first embodiment of the present invention.
Figure 7F:
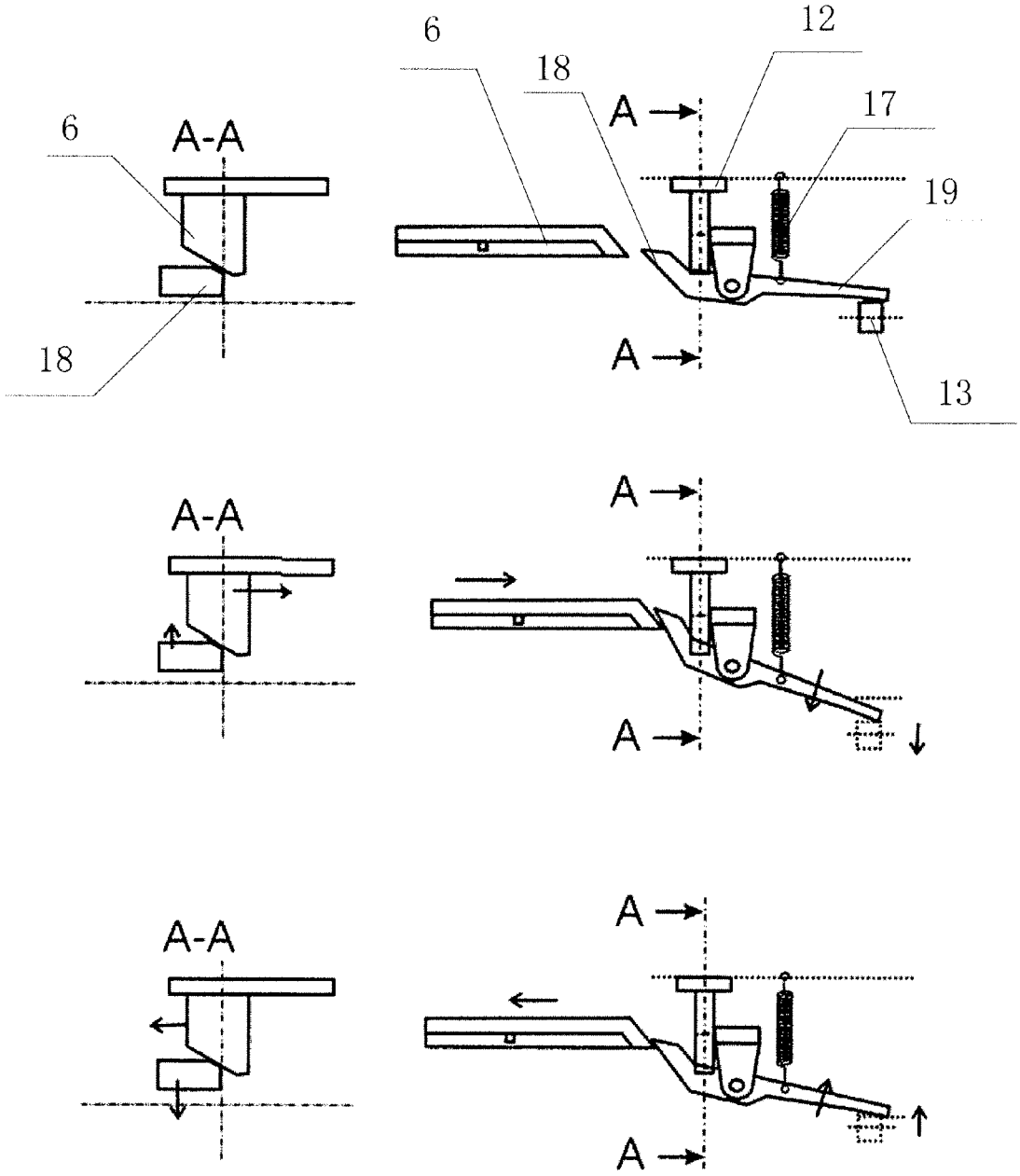
FIG. 7F is a local schematic diagram in the direction of the arrows C-D in FIG. 2 when the shell sensor level is lapped with a dart, according to the first embodiment of the present invention.

Additionally, as shown in FIGS. 7C and 7F, a reset spring 17 is provided. One end of the reset spring 17 is connected with the ejector control lever 7, and the other end is connected with the gun body. When the ejector control lever 7 begins to swing by means of the external force, the reset spring 17 may thereupon elongate or compress. When the external force applied on the reset spring 17 have been removed, the reset spring 17 can make the ejector control lever 17 return to its equilibrium position immediately, so as to prevent the ejector control lever 7 from staying at the position where the shell is ejected under the action of inertia.

Furthermore, the housing of the magazine is provided with an aperture at the position corresponding to the dart station close to the shell 1.

In the prior art, the shell together with the dart is firstly loaded into the magazine. Then the handle 10 is pulled back as a result of which the rotor of the magazine may rotate by one dart station. More specifically, in this embodiment, as 12 combinations of darts can be loaded into the cylinder, the magazine rotating by one dart station means the magazine rotating by 1/12 circumference. Then the shell loaded with the darts enters into the shell 1 for ejecting. Hereafter, the handle 10 is pushed forward to its most front end. The shell will remain in the magazine when the trigger 20 is pressed down to fire a dart. Subsequently, the handle 10 is pulled back again and the cylinder may rotate by one dart station for preparing for ejecting the next dart. When all the darts in the magazine have been fired, the magazine will be unloaded and the empty shell will be released before new darts are loaded. Therefore, during the operation, players have to unload the empty shell manually. Such complicated operations may affect both the game progress and the emotion of the players.

To simplify the operations, in the toy gun according to the embodiment of the present invention, a shell ejecting device is further provided for ejecting empty shells. Meanwhile, the structures of the magazine and the dart ejecting device belong to the prior art. When the trigger 20 is pressed down to eject the dart, the handle 10 is pulled back to make the cylinder rotate by one dart station. As a result, the dart station having an empty shell may withdraw from the shell 1, but still close to the shell 1. Meanwhile, the free end 15 of the dart sensor lever 4 is not lapped with a dart. Instead it is drooping at the position of the dart head in the dart station close to the shell 1. Hereafter, the handle 10 is pushed forward to drive the sliding piece 6 to move forward. In the following, a working process of the shell ejecting device will be illustrated.

In the first or second embodiments of the present invention, as shown in FIGS. 7A-7F, the stopper 12 is positioned proximate to the first end 18 of the ejector control lever 7. As illustrated in FIG. 3B or 4B, when the free end 15 of the dart sensor lever 4 is lapped with a dart, the contacting end 14 of the dart sensor lever 4 may pull down the transmission element 3. Furthermore, as shown in FIGS. 7A-7C, the transmission element 3 may drive the second linkage 5 in connection with it to move. By setting the length of the stopper 12, the stopper 12 may press down the first end 18 of the ejector control lever 7 under the control of the second linkage 5, causing the protrusion of the sliding piece 6 to stagger the end face of the first end 18. In another word, the sliding piece 6 has not interacted with the ejector control lever 7. Consequently, the shell with the dart wherein may keep staying in the magazine.

As illustrated in FIG. 3A or 4A, when the free end 15 of the dart sensor lever 4 is not lapped with a dart, the contacting end 14 may remove the pulling force from the transmission element 3, causing the second linkage 5 to revert to its free state. As illustrated in FIGS. 7D-7F again, the stopper 12 may no longer press the ejector control lever 7, causing the end face of the first end 18 to fully contact with the protrusion of the sliding piece 6. As the end face is a curved surface or an inclined surface, during the sliding piece 6 slides forward, the curved end face of the first end 18 is pressed against by the protrusion. When the handle 10 is pushed to its most front end, the first end 18 of the ejector control lever 7 may be lifted up by the sliding piece 6 completely. As a result, the ejector control lever 7 may swing violently, causing the second end 19 of the ejector control lever 7 corresponding to the first end 18 to strike the shell ejecting lever 13. After that, the shell ejecting lever 13 may strike the shell and consequently eject the empty shell out of the magazine.

Figure 8A:
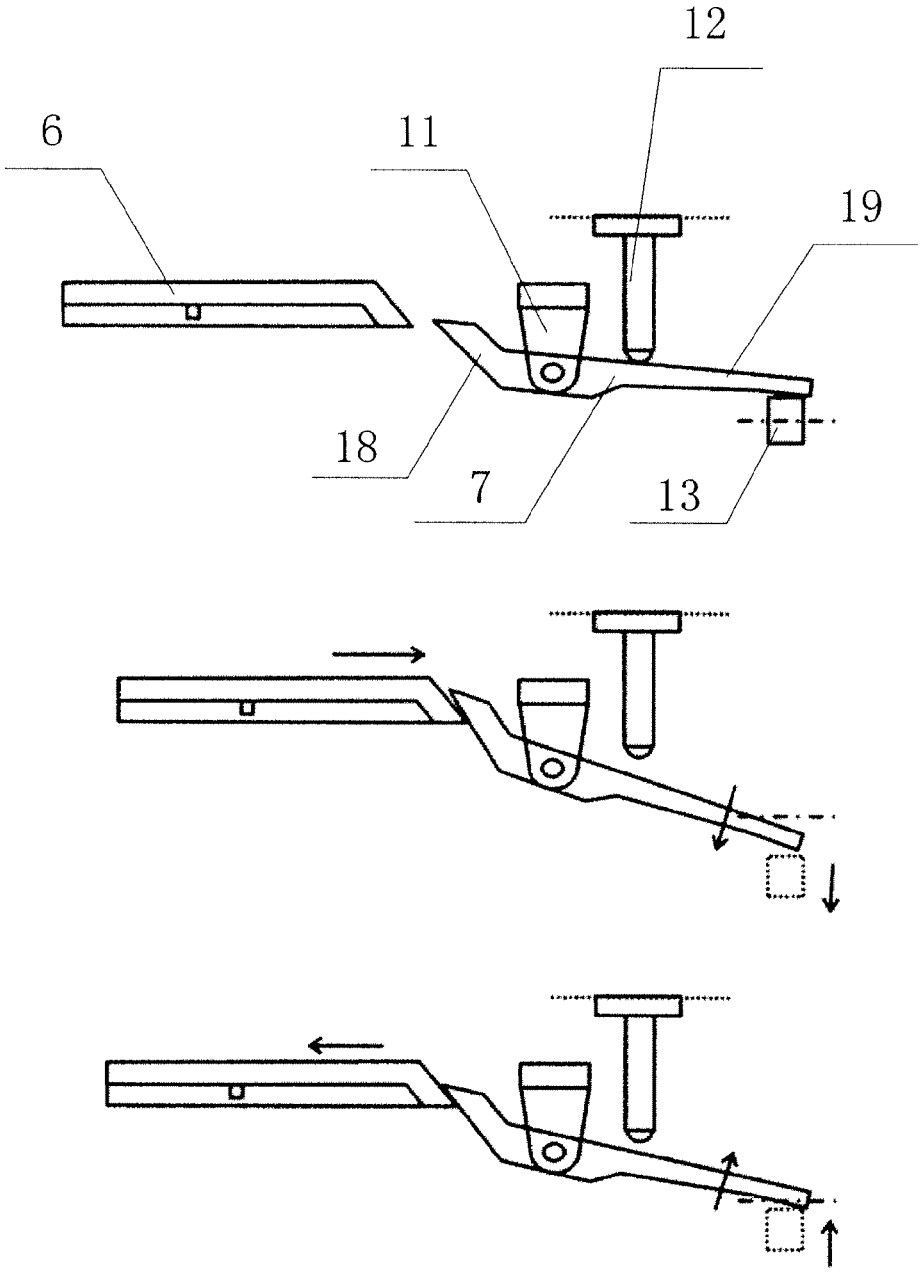
FIG. 8A is a first local section view in the direction of the arrows C-D in FIG. 2 when the shell sensor level is not lapped with a dart, according to the second embodiment of the present invention.
Figure 8B:
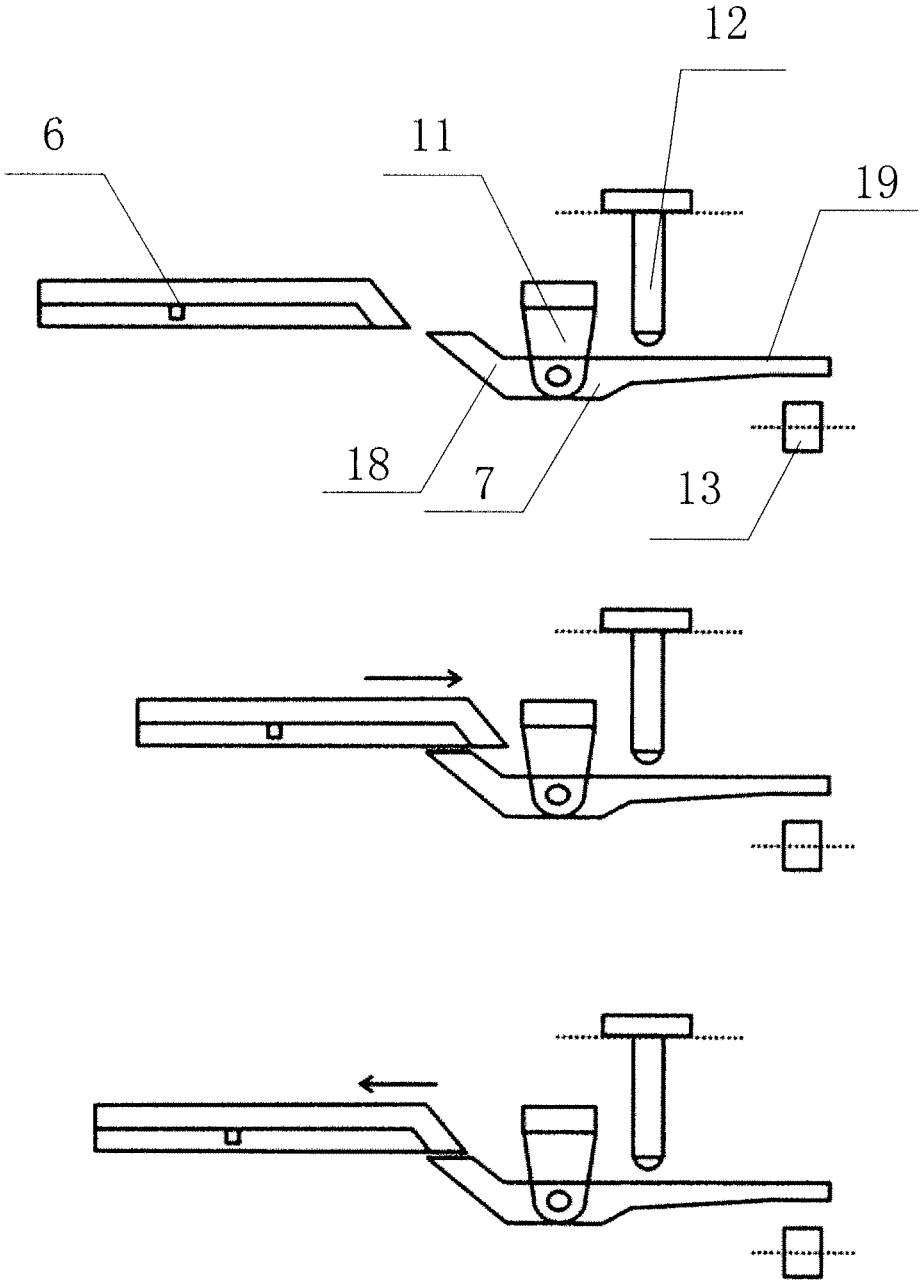
FIG. 8B is a second local section view in the direction of the arrows C-D in FIG. 2 when the shell sensor level is not lapped with a dart, according to the second embodiment of the present invention.

In the third embodiment of the present invention, as shown in FIGS. 8A and 8B, the stopper 12 is positioned proximate to the second end 19 of the ejector control lever 7. As illustrated in FIG. 7A, when the free end 15 at the position of the stopper 12 is controlled to be in the free state with no external force applied on it. As shown in FIG. 8A again, by setting the length of the stopper 12, the stopper 12 may press down the second end 19 of the ejector control lever 7 substantially, so that the first end 18 will tilt up by means of leverage to make the end face of the first end 18 fully contact with the protrusion of the sliding piece 6. Similarly as described above, the empty shell may be ejected out of the magazine consequently.

As illustrated in FIG. 5B, when the free end 15 of the dart sensor lever 4 is lapped with a dart, the second linkage 5 may move upward and drive the bottom end of the stopper 12 to leave the ejector control lever 7 so that the stopper 12 will no longer press the ejector control lever 7, as shown in FIG. 8B. As a result, the protrusion of the sliding piece 6 may stagger the end face of the first end 18. That is, the sliding piece 6 will not interact with the ejector control lever 7, and the shell having a dart therein will keep remaining in the magazine.

After the processes mentioned above have finished, the handle 10 will be pulled back. Then the sliding piece 6 withdraws from the first end 18 of the ejector control lever 7. Therefore, the external force applied on the ejector control lever 7 may have been removed, and the ejector control lever 7 may revert to its free state consequently. Correspondingly, the shell ejecting lever 13 may revert to its free state.

In a summary, as the toy gun is provided with a shell ejecting device, the toy gun is capable of ejecting the empty shells in the process of use without unloading the magazine. Meanwhile, the shell with a dart therein will not be misoperated to be ejected out.

The invention claimed is:

1. A toy gun, said toy gun comprising a dart ejecting device and a magazine for loading darts (9) and shells (8), characterized in that said toy gun also comprises a shell ejecting device which comprises a driving mechanism and a shell ejecting mechanism;

wherein said driving mechanism comprises a handle (10), a first linkage (2) through the center of the magazine, and a sliding piece(6), which are linked together in sequence;

said handle (10) may drive said sliding piece (6) to slide back and forth via said first linkage (2);

said shell ejecting mechanism comprises a ejector control lever (7), a pivot (11) and a shell ejecting lever (13);

an end face of a first end (18) of the ejector control lever (7) is a curved surface or an inclined surface to coordinate with said sliding piece (6), while a second end may be lapped with said shell ejecting lever (13) so as to control the shell ejecting lever (13).

2. A toy gun according to claim 1, wherein said shell ejecting device also comprises a dart sensor mechanism; said dart sensor mechanism comprises a dart sensor lever (4) fixed on a body of the gun in a hinging way, a second linkage (5) and a transmission element (3) positioned between said dart sensor lever (4) and said second linkage (5); said transmission element (3) is connected with said second linkage (5) so as to drive said second linkage (5) to move; said ejector control lever (7) is linked with said pivot (11) so as to swing around said pivot (11).

3. A toy gun according to claim 2, wherein a contacting end (14) of said dart sensor lever (4) is linked with said transmission element (3); while a corresponding free end (15) is drooping at the position of a dart head in a dart station close to a shell (1).

4. A toy gun according to claim 3, wherein said shell ejecting mechanism also comprises a stopper (12).

5. A toy gun according to claim 4, wherein said stopper (12) is positioned between said ejector control lever (7) and said second linkage (5), and is connected with said second linkage (5) so that the position of said stopper (12) is controlled by said second linkage (5).

6. A toy gun according to claim 1, wherein said shell ejecting mechanism also comprises a reset spring (17); one end of said reset spring (17) is connected with said ejector control lever (7) and the other end is connected with a body of the gun.

7. A toy gun according to claim 1, wherein said sliding piece (6) is provided with one end linked with said first linkage (2) and the other end provided with a protrusion.

8. A toy gun according to claim 5, wherein the contacting end (14) of said dart sensor lever (4) is provided with a hook, and said transmission element (3) is provided with a corresponding groove coordinating with said hook.

9. A toy gun according to claim 8, wherein said stopper (12) is positioned proximate to the first end (18) of said ejector control lever (7) relative to the pivot (11).

10. A toy gun according to claim 5, wherein said transmission element (3) is a linkage linked to the contacting end (14) of said dart sensor lever (4).

11. A toy gun according to claim 10, wherein said stopper (12) is positioned proximate to the first end (18) of said ejector control lever (7) relative to the pivot (11).

12. A toy gun according to claim 5, wherein the contacting end (14) of said dart sensor lever (14) leans to said transmission element (3), and the contacting surface of said transmission element (3) is an inclined plane.

13. A toy gun according to claim 12, wherein said stopper (12) is positioned proximate to the second end (19) of said ejector control lever (7) relative to the pivot (11).

14. A toy gun according to claim 1, wherein the housing of said magazine is provided with an aperture at the position corresponding to the dart station close to the shell (1) for ejecting the empty shell.

* * * * *